US006470072B1

(12) United States Patent
Johnson

(10) Patent No.: US 6,470,072 B1
(45) Date of Patent: Oct. 22, 2002

(54) X-RAY ANTI-SCATTER GRID

(75) Inventor: Mark A. Johnson, Charlton, NY (US)

(73) Assignee: General Electric Company, Schenectady, NY (US)

( * ) Notice: Subject to any disclaimer, the term of this patent is extended or adjusted under 35 U.S.C. 154(b) by 15 days.

(21) Appl. No.: 09/645,756

(22) Filed: Aug. 24, 2000

(51) Int. Cl.[7] ..... G21K 1/10
(52) U.S. Cl. ..... 378/154; 378/150; 378/155
(58) Field of Search ..... 378/154, 150, 378/155

(56) References Cited

U.S. PATENT DOCUMENTS 1,164,987 A * 12/1915 Bucky ..... 378/154
3,919,559 A * 11/1975 Stevens ..... 378/154
4,000,424 A 12/1976 Rouge et al.
4,969,176 A * 11/1990 Marinus ..... 378/149
5,291,539 A * 3/1994 Thumann et al. ..... 378/154
5,357,553 A * 10/1994 Ferlic et al. ..... 378/154
5,418,833 A 5/1995 Logan
5,455,849 A * 10/1995 Logan et al. ..... 378/154
5,557,650 A 9/1996 Guida et al.
5,581,592 A 12/1996 Zarnoch et al.
5,606,589 A * 2/1997 Pellegrino et al. ..... 378/154
5,949,850 A * 9/1999 Tang ..... 378/154
6,177,237 B1 1/2001 Guida et al.
6,222,904 B1 4/2001 Berestov
6,269,176 B1 7/2001 Barski et al.

* cited by examiner

*Primary Examiner*—Robert H. Kim
*Assistant Examiner*—Allen C. Ho
(74) *Attorney, Agent, or Firm*—Armstrong Teasdale LLP

(57) ABSTRACT

An injection molded anti-scatter grid is fabricated from an engineered thermoplastic to form a focused x-ray absorbent framework defining a plurality of inter-spaces. The engineered thermoplastic has higher yield strength than conventional anti-scatter grid fabrication materials, which produces a structurally rigid grid that renders conventional fiber-like inter-space material unnecessary, and further allows the grid to be flexed in one or more directions to change an effective focal length of the grid. The engineered thermoplastic is loaded with high density particles in order to be x-ray absorbent, while still maintaining desired structural properties.

15 Claims, 2 Drawing Sheets

X-RAY ANTI-SCATTER GRID

BACKGROUND OF THE INVENTION

This invention relates generally to diagnostic radiography, and, more specifically, to x-ray anti-scatter grids for improving x-ray image contrast.

During medical diagnostic radiography processes, x-rays are directed toward an object from an x-ray source. When x-rays are used to create an image of an object, a portion of the radiation, i.e., direct radiation, passes directly through the object unimpeded from the x-ray source and onto an x-ray detector to create an x-ray image on a photosensitive film or other suitable detector. Some of the direct radiation is differentially absorbed by the object, which creates a shadow of the object on the film or detector. A portion of the radiation is scattered and arrives at the x-ray detector at an angle which deviates significantly from its original path from the x-ray source. The scattered radiation results in a "veil" superimposed on the absorption image, thereby reducing contrast of the radiograph image. To counteract the reduced contrast due to scattered radiation, the amount of radiation exposure to the object is often increased. If scattered radiation is reduced or eliminated, contrast of the image can be enhanced, the radiation dose to the object (or patient) can be reduced, or both.

Radiation scattering can be reduced by using an x-ray anti-scatter grid. Anti-scatter grids are typically fabricated from thin sheets of x-ray absorbing material arranged in a geometric pattern to absorb scattered radiation, and a non-absorbent, fiber-like spacer material between absorbent sheets that allows direct radiation to pass through the anti-scatter grid. In one type of anti-scatter grid, known as a focused grid, the absorbent sheets are arranged approximately parallel to the direct x-ray beams emanating from an x-ray source. In a further type of anti-scatter grid, known as a focused cross grid, the absorbent sheets are arranged in a mesh and focused along two substantially perpendicular axes. The cross grid is focused in two dimensions, and requires precise positioning of the anti-scatter grid relative to the x-ray source. The focal lengths of the focused grids are typically fixed, and the relative location of the x-ray source and anti-scatter grid must remain fixed to achieve acceptable radiograph results. It would be desirable to provide a variable focal length grid to allow more flexibility in setting up x-ray procedures.

Focused anti-scatter grids are typically manufactured by laying-up, or stacking, alternate layers of absorbing material and spacer material and bonding them together. The grid components are aligned during assembly to obtain the desired focus. Alternatively, very fine slits are formed in an x-ray transparent material in a focused pattern, and the slits are filled with x-ray absorbing material to form a focused grid. See, for example, U.S. Pat. Nos. 5,557,650 and 5,581,592. In yet another manufacturing technique, a photo-resist and chemical etching process is used to fabricate slightly different layers of absorbing material in a mesh like pattern. The layers are stacked and appropriately bonded to form a focused cross grid. See, for example, U.S. Pat. Nos. 5,606,589 and 5,814,235. Each of the above manufacturing methods, however, are complicated and tedious, and often result in large variations in grid quality.

Accordingly, it would be desirable to provide a focused anti-scatter grid that may be manufactured more quickly and easily in comparison to known x-ray grids. In addition, it would be desirable to provided an anti-scatter grid that has an adjustable, or variable, focal length.

BRIEF SUMMARY OF THE INVENTION

In an exemplary embodiment of the invention, an x-ray anti-scatter grid includes an integrally formed geometric grid structure defining a plurality of spaces. An inter-space material is located in the spaces, and the grid structure and inter-space material are configured to flex along at least one axis, thereby changing an effective focal length of the grid.

More specifically, the grid structure is injection molded and fabricated from a thermoplastic material to form a rigid but flexible grid that may be flexed along at least one axis to change the effective focal length of the grid. An injection molded cross grid could be flexed along a second axis to further improve x-ray image contrast. By injection molding the grid from thermoplastic material, labor intensive manufacturing techniques of known anti-scatter grids may be avoided, and hundreds of anti-scatter grids may be manufactured quickly and inexpensively.

Also, injection molding allows air to be used as the inter-space material, rather than fiber-like, low density material used in conventional anti-scatter grids. Because the fiber-like material absorbs a measurable portion of x-rays, by eliminating the fiber-like material, radiation energy that reaches the x-ray detector is increased. Consequently, a higher quality image is realized with a given radiation dose, or conversely, the radiation dose can be reduced while still achieving a high contrast image comparable to known anti-scatter grids.

Therefore, a more versatile anti-scatter grid is provided that may be manufactured more quickly and easily relative to known anti-scatter grids, thereby reducing manufacturing costs of anti-scatter grids.

DETAILED DESCRIPTION OF THE INVENTION

Figure 1:
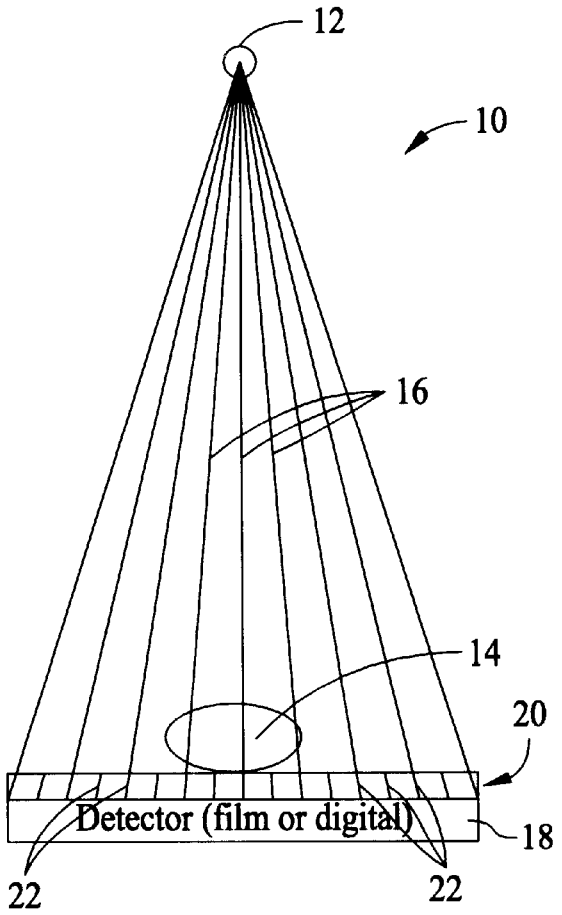
FIG. 1 is a schematic view of a radiographic imaging arrangement in a first configuration.

FIG. 1 is a schematic view of a radiographic imaging arrangement 10 including an x-ray source 12, such as an x-ray tube, that generates and emits x-radiation, or x-rays, toward an object 14. A portion of the x-rays are differentially absorbed by object 14 and a portion of the x-rays penetrate object 14 and travel along paths 16 as primary, or direct, radiation. Still another portion of the x-rays penetrates object 14 and is deflected from paths 16 as scattered radiation. The direct and scattered x-rays travel toward a photosensitive film 18, and the exposure of film 18 creates a radiograph, or x-ray, image. In an alternative embodiment, imaging arrangement 10 includes a digital system using a digital detector in lieu of photosensitive film 18. To increase the x-ray image contrast, radiograph imaging arrangement 10 includes an anti-scatter grid 20.

Anti-scatter grid 20, in one embodiment, is a focused grid including a plurality of x-ray absorbent members 22 arranged in a geometric pattern that is focused, i.e., arranged approximately parallel to the direct x-ray beams emanating from x-ray source 12. Therefore, scattered radiation, or radiation that arrives at x-ray anti-scatter grid 20 at an angle different from its original path generated by x-ray source 12, impinges x-ray absorbing members 22 and the scattered radiation is substantially absorbed and prevented from reaching photosensitive film 18. Direct radiation passes through anti-scatter grid 20 between x-ray absorbent members 22 for exposure with photosensitive film 18 to generate a clear radiograph image.

Figure 2:
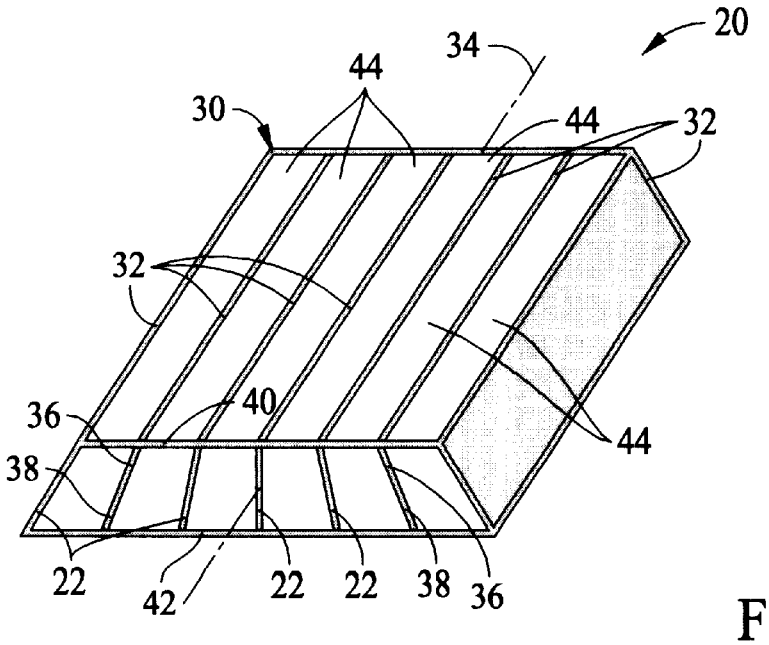
FIG. 2 is a perspective view of an exemplary one dimensional anti-scatter grid.

FIG. 2 is a perspective view of exemplary focused anti-scatter grid 20 fabricated from an injection molded engineered thermoplastic into an integral framework 30 of x-ray absorbent members 22. A plurality of flat sheets 32 of x-ray absorbent material are arranged generally parallel to a longitudinal axis 34 of anti-scatter grid 20, but generally inclined to one another to form a focused geometric grid 20 along a longitudinal dimension of grid 20. Each x-ray absorbent sheet 32 is connected at a respective top edge 36 and bottom edge 38 of each sheet 32 by a first cross member 40 and a second cross member 42 substantially parallel to first cross member 40. Framework cross members 40, 42 maintain absorbent sheets 32 in proper position relative to one another and strengthen or rigidify anti-scatter grid 20 for handling during x-ray procedures. Framework cross members 40, 42 are essentially x-ray transmissive. A plurality of inter-spaces 44 are formed between x-ray absorbent sheets 32 and each inter-space 44 receives a spacer material that is x-ray transmissive, i.e., substantially non-absorbent of x-ray radiation, so that direct radiation travels through inter-spaces 44 substantially unimpeded. Integral molding of x-ray anti-scatter framework 30 renders conventional fiber-like inter-space material structurally unnecessary so that, in one embodiment, inter-space material is air. In alternative embodiments, fiber-like inter-space material known in the art is arranged between x-ray absorbent sheets 32, and framework cross members 40, 42 may be removed when the assembly is complete.

In one embodiment, x-ray anti-scatter grid 20 is injection molded from an engineered thermoplastic material loaded with high density particles for x-ray absorption, yet with a sufficiently high yield strength suitable for x-ray applications and suited for injection or compression molding using conventional equipment. Suitable high density particles for use in loading the thermoplastic material are known in the art, and include, for example, lead, but non toxic alternatives such as copper, tungsten, and the like may be appropriately selected to avoid toxicity issues.

One such suitable thermoplastic material, for example, is an ECOMASS™ compound that is commercially available from M.A. Hannah Engineered Materials of Norcross, Ga. ECOMASS™ is a tungsten-thermoplastic mix that can be formulated to have a density equal to lead, which has been conventionally used to fabricate x-ray absorbent sheets, but with a greater yield strength than lead. Thus, a higher yield strength of anti-scatter grid 20 fabricated from ECOMASS™ is not only more structurally sound than conventional anti-scatter grid materials but is pliable or flexible, as further described below, along one or more axes of the grid, such as longitudinal axis 34.

In addition, by injection molding anti-scatter grid 20, tedious manufacturing processes conventional in the art may be avoided, and anti-scatter grid 20 may be manufactured more quickly and more reliably than a conventional focused grid.

Figure 3:
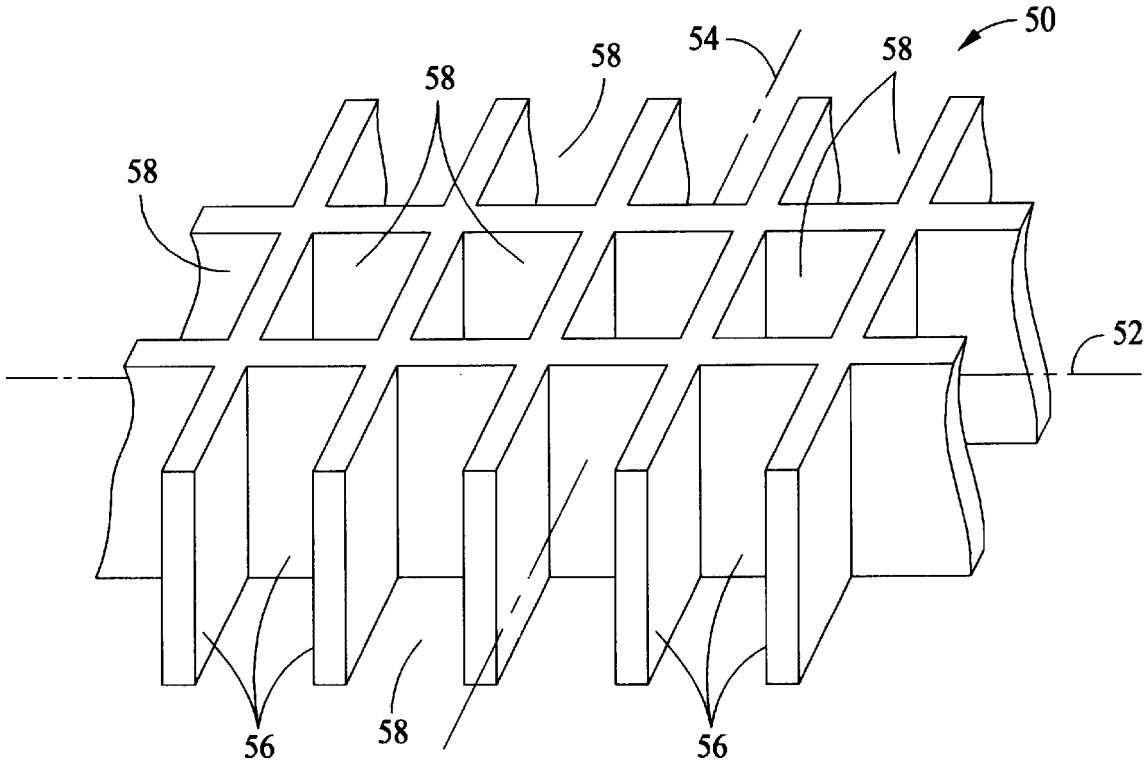
FIG. 3 is a partial perspective view of an exemplary two-dimensional focused grid.

FIG. 3 is a partial perspective view of another embodiment of an anti-scatter grid 50, including two substantially perpendicular axes 52, 54 along which x-ray absorbent sheets 56 are arranged in a parallel fashion with respect to axes 52, 54, but inclined relative to one another to form a two-dimensional focused grid 50. In other words, anti-scatter grid 50 is focused in two directions. Thus, a focused mesh is created that defines inter-spaces 58 between x-ray absorbent sheets 56. A spacer material that is x-ray transmissive, i.e., substantially non-absorbent of x-ray radiation, is received in inter-spaces 58 so that radiation travels through inter-spaces 58 substantially unimpeded. Integral molding of x-ray absorbent sheets 56 renders conventional fiber-like inter-space material structurally unnecessary so that, in one embodiment, inter-space material is air. In alternative embodiments, fiber-like inter-space material known in the art is arranged between x-ray absorbent sheets 56.

Anti-scatter grid 50 is integrally fabricated from an injection molded engineered thermoplastic, such as ECOMASS™ into a framework of x-ray absorbing members or sheets 56. Using conventional equipment and conventional techniques, a high density, high yield strength mesh framework is formed into a focused cross grid while eliminating the manufacturing challenges of conventional cross grids.

Because of the increased yield strength afforded by the engineered thermoplastic material, anti-scatter grid 50 is pliable and may be flexed about one or both of axes 52, 54 to adjust or vary a focal length of grid 50 in one or more directions. For example, by flexing grid 50 about both axes 52, 54 a substantially equal amount, a substantially spherical focused grid may be formed and used for a certain x-ray procedure. To accommodate a different procedure, grid 50 may be flexed in an opposite fashion and returned to its previous form. Thus, a wide variety of interim anti-scatter grid configurations may be realized in a single grid 50 to accommodate a large number of x-ray procedures. It is contemplated that a grid could be formed having different stiffness along pre-determined axes to allow easier flexing in one direction than in another, or to prohibit flexing in a given direction but allowing it in others to facilitate acquisition of desired focal lengths.

Figure 4:
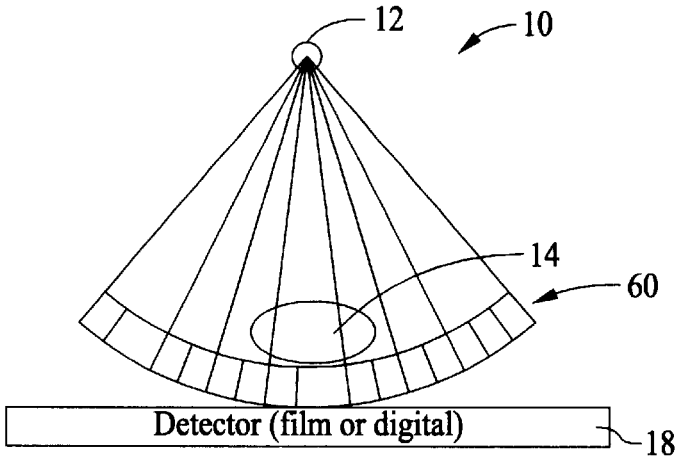
FIG. 4 is a schematic view of the radiographic imaging system shown in FIG. 1 in a second configuration.

FIG. 4 illustrates radiographic imaging arrangement 10 including a flexed anti-scatter grid 60, which may be a one dimensional focused anti-scatter grid, such as grid 20 (shown in FIG. 2), or a two dimensional focused anti-scatter grid, such as grid 50 (shown in FIG. 3) to adjust the focal length of imaging arrangement 10. When anti-scatter grid 60 is flexed, an orientation of absorbent sheets and inter-space material is altered, and hence the effective focal length of grid 60 is changed to accommodate different requirements of different x-ray procedures.

Thus, unlike conventional focused anti-scatter grids, a cost-effective, easily manufactured and stronger anti-scatter grid is provided using non toxic materials. Elimination of fiber like inter-space material increases contrast of radiograph images, and the higher yield strength of engineered thermoplastics allows a more versatile grid capable of flexing between two or more interim positions to accommodate a variety of x-ray procedures. Due to elimination of conventional fiber-like inter-space material that absorbs a measurable portion of x-rays, a higher quality image is realized with a given radiation dose, or conversely, the radiation dose can be reduced while still achieving a high contrast image comparable to known anti-scatter grids.

While the invention has been described in terms of various specific embodiments, those skilled in the art will recognize that the invention can be practiced with modification within the spirit and scope of the claims.

What is claimed is:

1. A variable focal length x-ray anti-scatter grid comprising:

a plurality of pliable radiation absorbent members geometrically arranged relative to one another to absorb scattered radiation; and inter-space material between said radiation absorbing members, said grid is configured to flex along a first axis and a second axis, thereby allowing interim adjustment of an effective focal length of said grid to accommodate different x-ray procedures.

2. A variable focal length x-ray anti-scatter grid in accordance with claim 1 wherein said plurality of radiation absorbent members are integrally formed.

3. A variable focal length x-ray anti-scatter grid in accordance with claim 1 wherein said inter-space material is air.

4. A variable focal length x-ray anti-scatter grid in accordance with claim 1 wherein said radiation absorbent members are focused for convergence with an x-ray source.

5. A variable focal length x-ray anti-scatter grid comprising:

a plurality of integrally formed injection molded pliable radiation absorbent members geometrically arranged relative to one another to absorb scattered radiation; and inter-space material between said radiation absorbing members.

6. A variable focal length x-ray anti-scatter grid comprising:

a plurality of pliable radiation absorbent members geometrically arranged relative to one another to absorb scattered radiation, said radiation absorbent members fabricated from a loaded thermoplastic mix; and inter-space material between said radiation absorbing members.

7. An x-ray anti-scatter grid comprising:

an integrally formed geometric grid structure defining a plurality of spaces; and an inter-space material located in said spaces, said grid and said inter-space material configured to flex along at least one axis, thereby allowing interim adjustment of an effective focal length of said grid to accommodate different x-ray procedures.

8. An x-ray anti-scatter grid in accordance with claim 7 wherein said grid structure is injection molded.

9. An x-ray anti-scatter grid in accordance with claim 7 wherein said grid structure is fabricated from a loaded thermoplastic material.

10. An x-ray anti-scatter grid in accordance with claim 9 wherein said thermoplastic material is a tungsten-thermoplastic mix.

11. An x-ray anti-scatter grid in accordance with claim 7 wherein said inter-space material is air.

12. An x-ray anti-scatter grid in accordance with claim 7 wherein said grid structure comprises a cross-grid.

13. An x-ray anti-scatter grid in accordance with claim 12 wherein said grid and said inter-space material is configured to flex along at least a second axis.

14. A method of improving x-ray image contrast with a variable length x-ray anti-scatter grid for use with an x-ray source emitting direct x-rays, said x-ray anti-scatter grid including an integrally formed geometric grid structure defining a plurality of spaces and an inter-space material located in the spaces, the x-ray anti-scatter grid focused along at least one axis at a first focal length for a first x-ray procedure, said method comprising the steps of:

selecting a second focal length for use in a second x-ray procedure;

flexing the integrally formed anti-scatter grid structure along the at least one axis until the second focal length is obtained; and positioning the anti-scatter grid between the x-ray source and the x-ray detector at the second focal length so that the anti-scatter grid absorbs radiation that is non-coincident with the direct rays of the x-ray source.

15. A method in accordance with claim 14 wherein the grid and inter-space material are configured to flex along a second axis, said method further comprising the step of flexing the anti-scatter grid along the second axis to form a substantially spherical grid.

* * * * *